United States Patent [19]

Conley

[11] Patent Number: 4,708,576

[45] Date of Patent: Nov. 24, 1987

[54] ACCESSORY FOR EXPANDING THE PAYLOAD CAPACITY OF A FORKLIFT

[75] Inventor: Challie Conley, Villa Park, Calif.

[73] Assignee: Emmett Hines, Dana Point, Calif.

[21] Appl. No.: 817,147

[22] Filed: Jan. 8, 1986

[51] Int. Cl.[4] ..... B66F 9/06

[52] U.S. Cl. ..... 414/607; 414/785

[58] Field of Search ..... 414/607, 608, 664–671, 414/785, 631

[56] References Cited

U.S. PATENT DOCUMENTS

| | | | |
|---|---|---|---|
| 2,818,989 | 1/1958 | Burke | 414/785 X |
| 3,045,847 | 7/1962 | Fisher | 414/607 X |
| 3,500,891 | 3/1970 | Collins | 414/607 X |
| 3,876,039 | 4/1975 | Bushnell, Jr. | 414/785 X |
| 3,889,833 | 6/1975 | Thomas | 414/607 |
| 4,239,446 | 12/1980 | Vucinic | 414/607 X |

*Primary Examiner*—Joseph E. Valenza
*Assistant Examiner*—David A. Bucci
*Attorney, Agent, or Firm*—Price, Gess & Ubell

[57] ABSTRACT

An improved forklift apparatus can be provided by utilization of a forklift extension kit including an elongated base member that is removably attached to the forks of the forklift vehicle. Auxiliary fork assemblies are releasably attached to the base member and can be subjectively positioned along the base member to lie parallel with the vehicle forks. Locking and safety mechanisms can be mounted on the base member and fork assemblies to prevent any inadvertent displacement of the fork assemblies.

19 Claims, 5 Drawing Figures

FIG 1
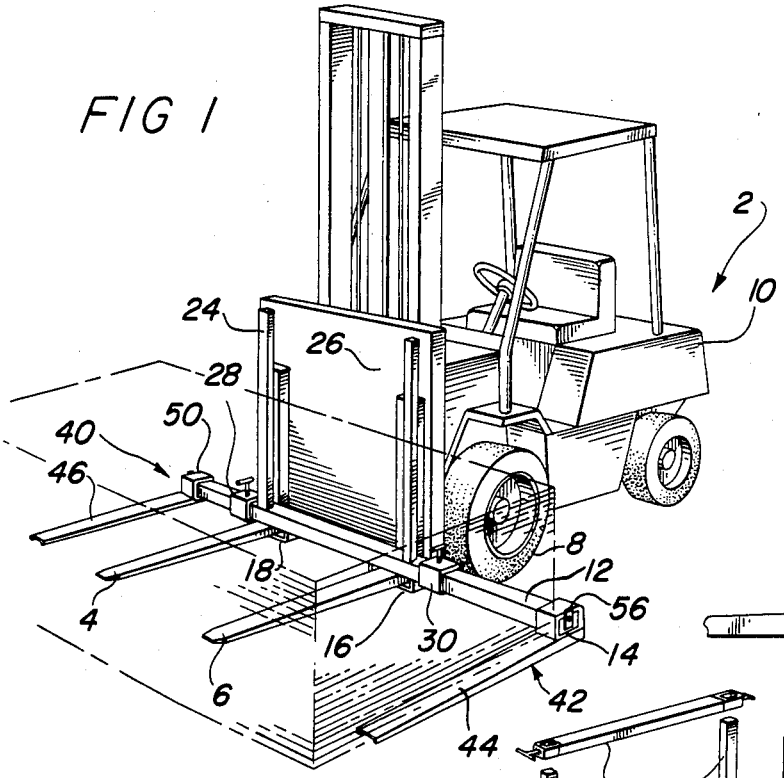
FIG. 3
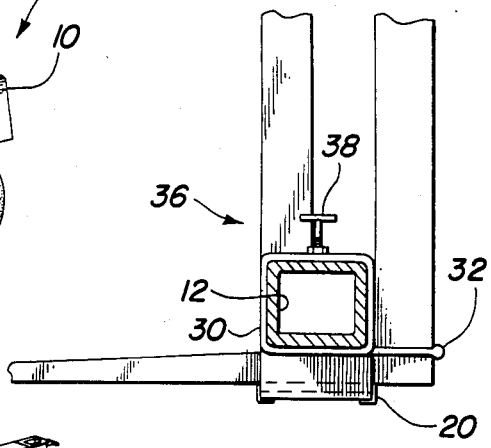
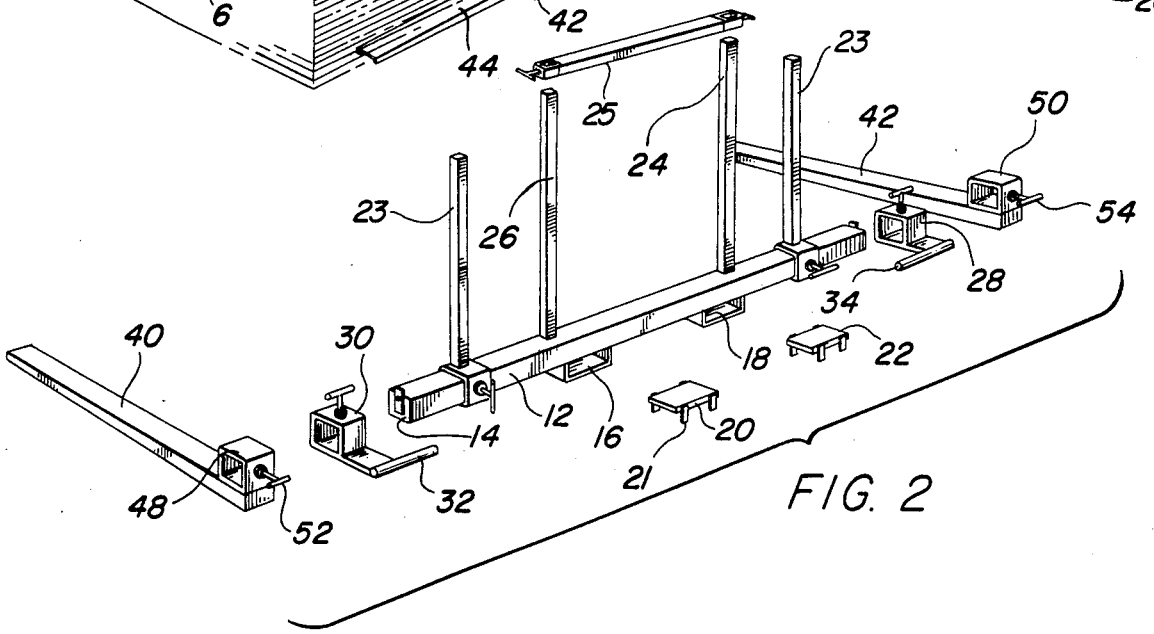
FIG. 2
FIG. 5
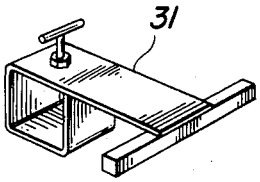
FIG. 4
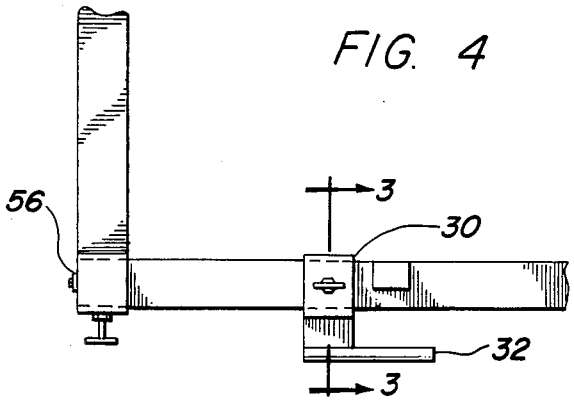

ACCESSORY FOR EXPANDING THE PAYLOAD CAPACITY OF A FORKLIFT

BACKGROUND OF THE INVENTION

Field of the Invention

The present invention is directed toward an improvement in forklift vehicles and the like and, more particularly, to an accessory kit that is capable of extending the capacity of a forklift to pick up and carry wide payloads.

Description of the Prior Art

Forklift vehicles have been employed in numerous jobs to lift containers and pallets of material. Frequently, the forks which can be moved in a vertical direction and also tilted in the horizontal direction can be adjusted on the forklift vehicle to vary the width between the forks. The widths between the forks, however, are usually limited due to the structural design of the forklift vehicle. There have been prior art suggestions to pivot support members from the forklift vehicle to accommodate wider loads.

A particular problem has occurred in the construction business in moving pallets of dry wall panels. Frequently, as much as 10% of the moved dry wall panels are damaged or cracked due to the bending of the outer edges about the support points of the forks. Additionally the number of dry wall panels that can be carried by a forklift truck is also limited, not only because of weight limitations but also because of the exaggerated bending that can occur with heavier loads. Attempts to strengthen or support the dry wall have been inadequate and this industry has been forced to accept a certain percentage of breakage. Thus, there is a need to improve the payload capacity of conventional forklift vehicles without damaging the items carried.

SUMMARY OF THE INVENTION

The present invention provides an improved forklift vehicle through the modification of a standard forklift vehicle with a forklift extension kit. An elongated base member is provided to be mounted so that it extends traverse to the longitudinal axes of the forks on the forklift vehicle and to extend on either side of the forklift vehicle. A pair of slidable first bracket members, adapted to extend around the base member, can be used for locking the elongated base member to the forks. A pair of fork assemblies, each having a cantilevered fork member with an upper second bracket member is adapted to extend around the base member and is also slidable along the base member while retaining the fork members in a parallel alignment with the forklift vehicle forks. Each of the first and second bracket members can be releasably secured to the base member. The elongated base member also has lower U-shaped brackets for receiving the respective forks of the forklift vehicle. Mounted above the U-shaped brackets and extending upward from the elongated base member are respective abutment posts for contacting the payload. Safety latches can be positioned at either end of the elongated base member to ensure that the fork assembly will not be vibrated off of the elongated base member if the second bracket members inadvertently release the fork assemblies.

Finally, auxiliary abutment posts and stabilizing cross bars can be removably mounted respectively on the base member and its abutment posts.

BRIEF DESCRIPTION OF THE DRAWINGS

The objects and features of the present invention will become readily apparent from the following detailed description taken in conjunction with the preferred embodiment thereof, with reference to the accompanying drawings, in which like parts are designated by like reference numerals and in which:

FIG. 1 is a schematic side front perspective view of an improved forklift assembly incorporating some of the component parts of the extension kit of the present invention;

FIG. 2 is an exploded side rear perspective view of the component parts of the extension kit of the present invention;

FIG. 3 is a side cross-sectional view taken along the lines 3—3 of FIG. 4;

FIG. 4 is a partial plan view of the present invention; and

FIG. 5 is a perspective view of another embodiment of the fork lock brackets.

DETAILED DESCRIPTION OF THE PREFERRED EMBODIMENT

The following description is provided to enable any person skilled in the forklift and building industry to make and use the invention, and it sets forth the best mode contemplated by the inventor of carrying out the invention. Various modifications, however, will remain readily apparent to those skilled in the above art, since the generic principles of the present invention are applied herein specifically to provide a relatively economical and easily manufactured forklift extension kit.

Referring to FIG. 1, an improved forklift assembly 2 having a pair of conventional forks 4 and 6 that can be operated in a conventional manner is shown. The vehicle can move the forks 4 and 6 beneath a desired payload, such as dry wall panels, usually mounted on a pallet, (not shown) and the forks 4 and 6 can be both raised and tilted backwards to facilitate transporting the payload to the desired location. An appropriate motor, not shown, can drive the front and rear wheels 8 for transporting the payload across a support surface. The body member 10 along with the forks 4 and 6 need not be altered to incorporate the advantages of the present invention.

To facilitate adding the present invention to a conventional forklift vehicle and subsequently removing it to perform jobs that do not require the present invention, an elongated base member 12 is provided that can be removably attached to the forks 4 and 6. The base member 12 is preferably formed from a hollow, metal square tube that is welded closed with a pair of end caps 14. A pair of U-shaped brackets 16 and 18 are welded at the bottom of the base member 12 and are of a dimension to securely receive the respective forks 4 and 6 by movement along the longitudinal axes of the forks 4 and 6 until it contacts the vertical base portion of the respective forks. The standard thickness of forks is approximately 2" and spacer adapters 20 and 22 are capable of being mounted within the U-shaped brackets if only $1\frac{1}{2}$ thick forks are provided on the forklift apparatus, see FIG. 3. The adapters 20 and 22 include tabs 21 that can be installed within the brackets and bent over the edges of the brackets to adjust the internal height of the apertures in the brackets.

Abutment or support posts 24 and 26 extend upward from the base member 12 on the other side of the U-shaped brackets 16 and 18. These support posts are formed from hollowed 2"×2" square tubing that is approximately 30" in height. They are usually positioned approximately 4 feet apart from their exterior outer surfaces. The support posts 24 and 26 act principally as spacers and extend upward from the front elevational surface of the base member 12 for contacting the payload.

To secure the base member 12 so that it extends in a direction traverse to the longitudinal axis of each of the forks, a right- and a left-hand fork lock brackets 28 and 30 are utilized. Referring to FIGS. 3 and 4, the fork lock brackets have a hollow, cross-sectional square configuration to permit a sliding movement along the operative length of the base member 12. Each fork lock bracket has a cantilevered retainer member or rod 32 and 34 that is dimensioned to extend behind the forklift assembly fork and thereby capture the base member 12 and prevent it from moving along the longitudinal axis of the fork. The forklift brackets are releasably secured by a locking mechanism 36 which can include a threaded aperture either in the body of the locking bracket or on the body of the locking mechanism 36 which can include a threaded aperture either in the body of the locking bracket or on the body of the locking bracket for receiving a threaded shaft 38 with a traverse bar for grasping by the user. The position of the support posts 24 and 26 prevent the payload, carried by the forklift assembly, from interfering or damaging the locking mechanism 36. As can be appreciated, when each of the respective fork lock brackets 28 and 30 are slid along the base member 12 and their respective locking mechnisms are activated, the forks 4 and 6 are captured not only by the U-shaped brackets 16 and 18, which prevent Traverse movement to the longitudinal axes of the forks, but also by the fork lock brackets 28 and 30 that prevent any movement along the longitudinal axes of the forks.

Referring to FIG. 5, an alternative fork lock bracket 31 is shown. The design of this bracket allows a more universal connection to a forklift assembly 2 and further eliminates the necessity of the spacer adapters because the base member 12 is cantilevered from the forklift assembly 2 by a bracket 31 on either side of the abutment posts 24 and 26.

Referring again to FIGS. 1 and 2, the auxiliary fork assemblies 40 and 42 comprise cantilevered fork members 44 and 46 that can be welded or attached to upper bracket members 48 and 50, respectively. The fork members can, for example, comprise ¼" steel plates that can be bent into a cross-sectional "U" configuration having approximately a 4" upper surface width and sides starting at approximately 1" at the tips and extending to 2" through a gradual slope at the rear of the upper brackets. While solid fork members can be use, the preferred embodiment uses the lighter weight U-shaped forks 44 and 46. The respective auxiliary fork brackets 48 and 50 have square apertures of a dimension to permit a sliding movement across the operative length of the base member 12. Locking mechanisms 52 and 54 are provided, respectively, on the brackets 48 and 50. Since these locking mechanisms are attached on the back surface of their respective brackets 48 and 50 relative to the positioning of the payload, they are not subject to any contact or damage from the payload.

As can be readily appreciated, the fork assemblies 40 and 42 are always maintained in a parallel alignment with the axes of the respective vehicle forks 4 and 6 as they slide along the operative length of the base member 12. The operative length of the base member 12 extends on either side of the forklift forks from the outer exterior surface of the respective brackets 18 and 16 to the end caps 14. As a further safety measure, safety locks 56 are mounted on each of the respective end caps 14. The safety locks comprise a lever pivotably mounted adjacent the upper surface of the elongated base member 12. The pivot point on the lever and the end cap 14 is positioned to displace the center of gravity of the lever member so that a portion of the lever is gravity biased to extend above the upper surface of the base member 12 to provide a lock function. An operator can rotate this lever 90° to release the locking action. Thus, any excessive vibration that may cause the locking mechanisms on the brackets 48 and 50 to release or a failure to apply the locking mechanisms will still not permit the fork assemblies 40 and 42 to fall off of the base member 12.

As can be readily appreciated, the fork assemblies 40 and 42 can be subjectively positioned to accommodate wide payloads by movement in a direction traverse to the longitudinal axes of the vehicle forks 4 and 6 along the base member 12. During this movement, the forks 44 and 46 retain a parallel position relative to the longitudinal axes of the vehicle forks 4 and 6. The operator can subjectively lock the fork assemblies at any desired position through the appropriate locking mechanisms 40 and 42.

To permit the stabilization of wide payloads, additional auxiliary abutment posts 23 can be removably locked at any position on the base member 12 at either side of the abutment posts 24 and 26. As shown in FIG. 2, the auxiliary posts 23 are locked onto the base member 12. However, in an actual mounting of the base member 12 to a forklift assembly 2, the fork lock bracket 28 and 30 would first be slid into position adjacent the respective abutment posts 24 and 26 before mounting the auxiliary posts 23 on the base member. Additionally, a supplemental cross bar 25 can be locked on the abutment posts 24 and 26.

The present inventor has attempted to provide a strong but relatively lightweight forklift extension kit that can modify conventional forklift vehicle to provide a new and improved forklift assembly. As can be readily appreciated, this forklift extension kit is completely removable but could also be permanently attached if desired for a dedicated use of the forklift assembly. The base member 12 has been designed to support the torque forces that would be asserted while still minimizing the amount of weight involved to permit a quick and convenient installation and removal of the forklift extension apparatus while not signifying reducing the total payload weight of the forklift vehicle.

While the preferred embodiment of the invention has been disclosed and described herein, it should be recognized that a person skilled in this field can make many modifications once given the broad teaching principles of the present invention.

Accordingly the scope of the present invention should be determined from the following claims, wherein I claim:

1. In a forklift apparatus that is capable of extending a plurality of cantilevered forks underneath a load and lifting the same, the improvement comprising:

an elongated base member removably attached to at least two forks to extend in directions transverse to a longitudinal axis of each fork;

means for securing the elongated base member to the forks including a first bracket member extending around the elongated base member and slidable along the elongated base member to lock the elongated base member to a fork of the forklift apparatus;

at least one removable fork assembly having a fork member attached to the base member and movable along its length, such that the fork member lies in substantially the same plane as the forklift apparatus forks, and extends from the base member in the same direction as the longitudinal axis of each of the forklift apparatus forks;

a safety latch member, mounted at the end of the base member for preventing the removal of the fork assembly; and means for releasably securing the fork assembly at any point along the operative length of the base member.

2. The invention of claim 1 wherein the fork member includes a fork member with a cross-sectional "U" configuration with a second bracket member mounted at one end and having an aperure complementing the exterior surface of the elongated base member.

3. The invention of claim 2 wherein the means for securing includes a threaded aperture in the second bracket member and a threaded shaft that can be adjusted to tighten against the elongated base member.

4. The invention of claim 1 further including spacer members for mounting between the forks and the elongated base member.

5. The invention of claim 1 wherein the safety latch member includes a lever pivotally mounted at the end of the elongated base member adjacent the upper surface, the pivot point being displaced from the center of gravity of the lever to ensure a portion of the lever is gravity biased to extend above the upper surface of the base member.

6. The invention of claim 1 wherein the first bracket member has a cross-sectional square configuration with a cantilevered retainer member extending on one side at a sufficient distance to extend behind a fork for attachment to the fork.

7. The invention of claim 1 wherein the elongated base member has a rectangular configuration and the fork member includes a fork member with a cross-sectional "U" configuration with a second bracket member mounted at one end and having an aperture complementing the exterior surface of the elongated base member.

8. The invention of claim 7 further including rectangular spacer members with projecting tabs on one side surface for mounting between the fork and the elongated base member.

9. The invention of claim 1 wherein the first bracket member has a cantilevered retainer member extending from its upper surface for connection to the forklift assembly.

10. A forklift extension kit for permitting a forklift vehicle, having a pair of forks, to securely carry wide loads, comprising:

an elongated base member adapted to be mounted to the forks and to extend on either side of the forklift vehicle;

a pair of first bracket members, adapted to extend around the base member and to be slidable along the base member, for locking the base member to the forks;

a pair of movable fork assemblies, each having a fork member and a second bracket member, the second bracket member is adapted to extend around the base member and to be slidable along the base member, while retaining the fork member in a parallel alignment with the forklift forks, and means for releasably securing the fork assemblies along the operative length of the base member whereby a load wider than the width of the position of the forklift forks can be supplementally supported through positioning of the fork assemblies along the base member.

11. The invention of claim 10 further including at each end of the elongated base member safety latch members for preventing the removal of the fork assembly.

12. The invention of claim 11 wherein the safety latch member includes a lever pivotally mounted at the end of the elongated base member adjacent the upper surface, the pivot point being displaced from the center of gravity of the lever to ensure a portion of the lever is gravity biased to extend above the upper surface of the base member.

13. The invention of claim 10 wherein the fork member has a second bracket member mounted at one end having an aperture complementing the exterior surface of the elongated base member.

14. The invention of claim 10 further including spacer members for mounting between the forks and the elongated base member.

15. The invention of claim 10 wherein the first bracket members have a cross-sectional square configuration with a cantilevered retainer member extending on one side at a sufficient distance to extend behind a vehicle fork for attachment to the vehicle fork.

16. The invention of claim 10 further including support posts connected to the elongated base member and projecting at a 90° angle to the fork members.

17. The invention of claim 16 further including an auxilliary support post having a lockable bracket member permanently attached at one end of the support post and movable along the base member.

18. The invention of claim 16 further including a lockable cross bar of a dimension to slide along and over the support posts.

19. The invention of claim 10 wherein the elongated base member further includes a pair of spaced U-shaped brackets for receiving the respective forks of the forklift vehicle.

* * * * *